US009608394B2

(12) United States Patent
Fruhauff

(10) Patent No.: US 9,608,394 B2
(45) Date of Patent: Mar. 28, 2017

(54) LIGHT BULB SOCKET ASSEMBLY

(71) Applicant: Jason Fruhauff, Crystal Lake, IL (US)

(72) Inventor: Jason Fruhauff, Crystal Lake, IL (US)

( * ) Notice: Subject to any disclaimer, the term of this patent is extended or adjusted under 35 U.S.C. 154(b) by 206 days.

(21) Appl. No.: 14/630,122

(22) Filed: Feb. 24, 2015

(65) Prior Publication Data

US 2016/0248207 A1 Aug. 25, 2016

(51) Int. Cl.
*H01R 33/22* (2006.01)
*H01R 33/94* (2006.01)

(52) U.S. Cl.
CPC ..... *H01R 33/22* (2013.01); *H01R 33/94* (2013.01)

(58) Field of Classification Search
CPC ..... H01R 33/22; Y10S 439/914
See application file for complete search history.

(56) References Cited

U.S. PATENT DOCUMENTS 1,104,577 A 7/1914 Thomas
1,702,135 A 2/1929 Sawers et al.
2,025,564 A 12/1935 Blake
2,122,848 A 7/1938 Sterns
2,308,016 A 1/1943 Mihalyi
2,409,650 A 10/1946 Wiggins
3,430,184 A 2/1969 Acord
3,478,302 A 11/1969 Chirumbolo
3,881,763 A 5/1975 Benson
4,121,134 A 10/1978 Fontenelle
4,440,467 A * 4/1984 Vologni ..... H01R 33/22 439/642
4,538,449 A 9/1985 Wegmann et al.
5,171,292 A 12/1992 Ortiz
5,380,214 A 1/1995 Ortega, Jr.
5,382,181 A 1/1995 Ortiz
6,162,100 A * 12/2000 Al-Turki ..... F21V 19/006 439/641
6,224,410 B1 5/2001 Chen
6,318,881 B1 * 11/2001 Lawrence ..... H01R 33/22 362/650
6,406,333 B2 6/2002 Harris
6,652,305 B1 11/2003 DiFusco
7,189,113 B2 3/2007 Sattelle et al.
7,234,842 B2 6/2007 Frederico
7,294,006 B1 11/2007 Chen
7,347,726 B2 3/2008 Wlos
(Continued)

OTHER PUBLICATIONS

Orbit 58108N Quick Connect Faucet Set, pre-2015, 1 page.

*Primary Examiner* — James Harvey
(74) *Attorney, Agent, or Firm* — McDonnell Boehnen Hulbert & Berghoff LLP.

(57) ABSTRACT

A light bulb socket assembly including an inner socket member having an interior chamber sized to receive a threaded end of a light bulb, and having a threaded member configured to screw into a conventional light bulb socket, a spring positioned between the inner socket member and an outer sleeve, locking tabs positioned extending through openings in an outer wall surrounding the interior chamber, where in a first secured position the locking tabs are in engagement with the threaded end of light bulb, and in a second unsecured position when the outer sleeve is refracted, the locking tabs are no longer in secured engagement with the threaded end of the light bulb, such that the light bulb may be removed by pulling the light bulb out of the inner socket member.

22 Claims, 11 Drawing Sheets

(56) References Cited

U.S. PATENT DOCUMENTS

| | | | | |
|---|---|---|---|---|
| 7,413,456 | B1 | 8/2008 | DiFusco | |
| 7,618,288 | B1 | 11/2009 | DiFusco | |
| 8,668,504 | B2 | 3/2014 | Confini | |
| 2013/0012040 | A1 | 1/2013 | Confini | |
| 2016/0248207 | A1* | 8/2016 | Fruhauff | H01R 33/94 |

* cited by examiner

LIGHT BULB SOCKET ASSEMBLY

BACKGROUND

The present application is generally directed to light bulb sockets. More particularly, the present application relates to a light bulb socket assembly for use with a conventional light bulb socket.

Conventional light bulbs have a threaded base that is rotated or screwed into a corresponding threaded portion of a conventional light bulb socket. When the light bulb burns out, the threaded base of the light bulb is unscrewed from the threaded light bulb socket and a replacement bulb may be rotated or screwed back into the corresponding threaded conventional light bulb socket.

Often light bulb sockets are located in hard to reach places such as on ceilings, or elevated on walls. As a result, the process of installing and replacing light bulbs may sometimes present a difficult or delicate process. For example, sometimes a light bulb may be screwed in too tightly and be difficult to remove. Other times the light bulb may be outdoors or in a "dirty" environment where the light bulb may become "frozen" in place. In these scenarios, removal of the light bulb may present a difficult task, particularly when the light bulb is in a hard to reach location.

Furthermore, on some occasions the light bulb may break during the removal process leaving the threaded base of the light bulb positioned within the threaded light bulb socket. Removal of the threaded base of the light bulb may require the use of a needle-nose pliers, a potato, or some other device to effect removal of the threaded base of the light bulb.

Accordingly, it would be desirable to provide a light bulb socket assembly that provides for easy installation and removal of a light bulb from a conventional light bulb socket, even when the light bulb becomes broken.

In addition, elderly people and people with arthritis may have difficulty screwing in or unscrewing a conventional light bulb having a threaded base. Therefore, it would be desirable to provide a light bulb socket assembly that made it easier to install and/or replace conventional threaded light bulbs. Although some efforts have been made to provide a light bulb socket assembly wherein the light bulb may be installed and removed without requiring rotation of the light bulb, such efforts have included complex socket assemblies and a large number of components.

Furthermore, in some instances, vibrations or disturbances may cause a light bulb to become partially unscrewed and break electrical connection with the light bulb socket even though remaining partially screwed into the light bulb socket. For example, in a manufacturing environment, the operation of machinery within the environment may cause vibrations that cause a light bulb to become partially unscrewed from the light bulb socket. Accordingly, it would be desirable to provide a light bulb socket assembly that helps to prevent a light bulb from becoming loose within the light bulb socket assembly based on vibrations or other disturbances in the environment.

In addition, it would also be desirable to provide a light bulb socket assembly that can be screwed into an existing conventional light bulb socket without requiring the formation of a special light bulb socket, wherein the light bulb can be installed into the light bulb socket assembly after the light bulb socket assembly has been screwed into the conventional light bulb socket.

As used herein, the term "conventional light bulb socket" means a light bulb socket adapted to receive a threaded base, where the threaded base comports with Edison Screw standards commonly used in North America or Europe, namely E12 in North America, E11 in Europe, E17 in North America, E14 in Europe, E26 in North America, E27 in Europe, E39 North America, and E40 in Europe, where E stands for Edison and the number that follows is the diameter in millimeters as measured across the peaks of the thread on the base (male) (i.e., E12 has a diameter of 12 mm). Therefore, "a conventional light bulb" is any light bulb having a threaded base adapted to be screwed into a conventional light bulb socket, whether the light bulb is incandescent, halogen, fluorescent, LED, or otherwise.

SUMMARY

In one aspect, a light bulb socket assembly is provided that can be screwed into a conventional light bulb socket. A light bulb may be inserted into an interior chamber of an inner socket member of the light bulb socket assembly. A spring biased outer sleeve may be pulled back to allow for easy installation and removal of the light bulb. However the outer sleeve is normally biased by the spring into a first secured position wherein a plurality of locking tabs that extend through openings in the inner socket member into the interior chamber advantageously lock into secure engagement with the threaded end of the light bulb so that it is held securely in place within the light bulb socket assembly and cannot be removed by pulling on the light bulb. To remove the light bulb the outer sleeve is simply pulled back to disengage the locking tabs from secure engagement allowing for the easy installation and removal of the light bulb without requiring that the light bulb be rotated during installation or removal.

In a further aspect, a light bulb socket assembly is provided including an inner socket member having an outer chamber defining an interior chamber, where the interior chamber is sized to receive a threaded end of a light bulb, a threaded member attached to a bottom of the inner socket member, where the threaded member is sized and configured to screw into a conventional light bulb socket, a spring positioned outside of the outer wall of the inner socket member, a plurality of locking tabs positioned on an outside of the outer wall of the inner socket member, wherein the tabs are extendable through a corresponding plurality of openings in the outer wall into the interior chamber, an outer sleeve positioned over the inner socket member, the spring, and the plurality of locking tabs, wherein the light bulb socket assembly has a first secured position wherein a tab engaging surface on the inner surface of the outer sleeve are forced into engagement with outer sides of the plurality of locking tabs forcing inner sides of the plurality of locking tabs into the interior chamber of the inner socket member such that when a threaded end of a light bulb is positioned within the interior chamber, the light bulb is secured within the inner socket member by the plurality of locking tabs in engagement with the threads of the threaded end of the light bulb, wherein the light bulb socket assembly has a second unsecured position when the outer sleeve is retracted longitudinally relative to the inner socket member towards a bottom of the inner socket member wherein the spring is compressed, and wherein the tab engaging surface on the inner surface of the outer sleeve is moved out of forced engagement with the outer sides of the plurality of locking tabs such that the locking tabs are no longer in secured engagement with the threads of the threaded end of the light bulb, such that the light bulb may be removed by pulling the light bulb out of the inner socket member.

In another aspect, a light bulb socket assembly is provided including an inner socket member having an outer wall defining an interior chamber, where the interior chamber is sized to receive a threaded end of a light bulb, a threaded member attached to a bottom of the inner socket member, where the threaded member is sized and configured to screw into a conventional light bulb socket, a spring positioned outside of the outer wall of the inner socket member, a plurality of locking tabs positioned on the outside of the outer wall of the inner socket member, wherein the plurality of locking tabs are extendable through a corresponding plurality of openings in the outer wall into the interior chamber, an outer sleeve positioned over the inner socket member, the spring, and the plurality of locking tabs, wherein the light bulb socket assembly has a first secured position wherein a top surface of the spring is forced into engagement with outer sides of the plurality of locking tabs forcing inner sides of the plurality of locking tabs into the interior chamber of the inner socket member such that when a threaded end of the light bulb is positioned within the interior chamber, the light bulb is secured within the inner socket member by the plurality of locking tabs in engagement with the threads of the threaded end of the light bulb, wherein the light bulb socket assembly has a second unsecured position when the outer sleeve has been moved longitudinally relative to the inner socket member towards a bottom of the inner socket member wherein the spring is compressed, and the top of the spring is moved out of forced engagement with outer sides of the plurality of locking tabs such that the locking tabs are no longer in secured engagement with the threads of the threaded end of the light bulb, such that the light bulb may be removed by pulling the light bulb out of the inner socket member.

In yet another aspect, a light bulb socket assembly is provided including an inner socket member having an outer wall defining an interior chamber, where the interior chamber is sized to receive a threaded end of a light bulb, a threaded member attached to a bottom of the inner socket member, where the threaded member is sized and configured to screw into a conventional light bulb socket, a spring positioned outside of the outer wall of the inner socket member, a plurality of locking tabs positioned on the outside of the outer wall of the inner socket member, wherein the tabs are extendable through a corresponding plurality of openings in the outer wall into the interior chamber, an outer sleeve positioned over the inner socket member, the spring, and the plurality of locking tabs, wherein the light bulb socket assembly has a first secured position wherein a tab engaging surface on the inner surface of the outer sleeve is forced into engagement with outer sides of the plurality of locking tabs forcing inner sides of the plurality of locking tabs into the interior chamber of the inner socket member such that when a threaded end of a light bulb is positioned within the interior chamber, the light bulb is secured within the inner socket member by the plurality of locking tabs in engagement with the threads of the threaded end of the light bulb, wherein the inner surface of the interior chamber of the inner socket member includes female threads adapted to receive the threaded end of the light bulb, and wherein the openings in the outer wall extend through openings in the female threads in the interior chamber of the inner socket member such that the locking tabs engage the threaded end of the light bulb when the light bulb has been threaded into the interior chamber of the inner socket member when the light bulb socket assembly is in the first secured position, and wherein the light bulb socket assembly has a second unsecured position when the outer sleeve has been moved longitudinally relative to the inner socket member towards a bottom of the inner socket member wherein the spring is compressed, and wherein a tab engaging surface on the inner surface of the outer sleeve is moved out of forced engagement with the outer sides of the plurality of locking tabs such that the locking tabs are no longer in secured engagement with the threads of the threaded end of the light bulb, such that the light bulb may be removed by unscrewing the threaded end of the light bulb from the female threads in the interior chamber of the inner socket member.

In another aspect, a light bulb socket assembly is provided consisting essentially of an inner socket member having an outer wall defining an interior chamber, where the interior chamber is sized to receive a threaded end of a light bulb, a threaded member attached to a bottom of the inner socket member, where the threaded member is sized and configured to screw into a conventional light bulb socket, an electrical contact extending between the threads of the threaded member and the interior chamber of the inner socket member adapted to electrically connect to the threaded end of the light bulb when it is positioned within the interior chamber, an electrical contact extending between the bottom of the threaded member and the interior chamber of the inner socket member adapt to electrically connect to the bottom of the threaded end of the light bulb when it is positioned within the interior chamber, a spring positioned outside of the outer wall of the inner socket member, a plurality of locking tabs positioned on the outside of the outer wall of the inner socket member, wherein the locking tabs are extendable through a corresponding plurality of openings in the outer wall into the interior chamber, an outer sleeve positioned over the inner socket member, the spring, and the plurality of locking tabs, wherein the light bulb socket assembly has a first secured position wherein a tab engaging surface on the inner surface of the outer sleeve is forced into engagement with outer sides of the plurality of locking tabs forcing inner sides of the plurality of locking tabs into the interior chamber of the inner socket member such that when a threaded end of the light bulb is positioned within the interior chamber, the light bulb is secured within the inner socket member by the plurality of locking tabs in engagement with the threads of the threaded end of the light bulb, wherein the light bulb socket assembly has a second unsecured position when the outer sleeve is moved longitudinally relative to the inner socket member towards a bottom of the inner socket member wherein the spring is compressed, and wherein the tab engaging surface on the inner surface of the outer sleeve is moved out of forced engagement with the outer sides of the plurality of locking tabs such that the locking tabs are no longer in secured engagement with the threads of the threaded end of the light bulb, such that the light bulb may be removed by pulling the light bulb out of the inner socket member.

BRIEF DESCRIPTION OF THE DRAWINGS

Exemplary embodiments of the invention are described herein with reference to the drawings, wherein like parts are designated by like reference numerals, and wherein.

DETAILED DESCRIPTION

The present embodiments are directed to a light bulb socket assembly that can be screwed into a conventional light bulb socket. A conventional light bulb may be inserted into an interior chamber of an inner socket member of the light bulb socket assembly. A spring biased outer sleeve may be pulled back to allow for easy installation and removal of the light bulb. However the outer sleeve is normally biased by the spring into a first locked position wherein a plurality of locking tabs extend through openings in the inner socket member into the interior chamber and advantageously lock into secure engagement with the threaded end of the light bulb so that it is held securely in place within the light bulb socket assembly and cannot be removed by pulling on the light bulb. To remove the light bulb the outer sleeve is simply pulled back to disengage the locking tabs from secure engagement allowing for the easy installation and removal of the light bulb without requiring that the light bulb be rotated during installation or removal.

Figure 1:
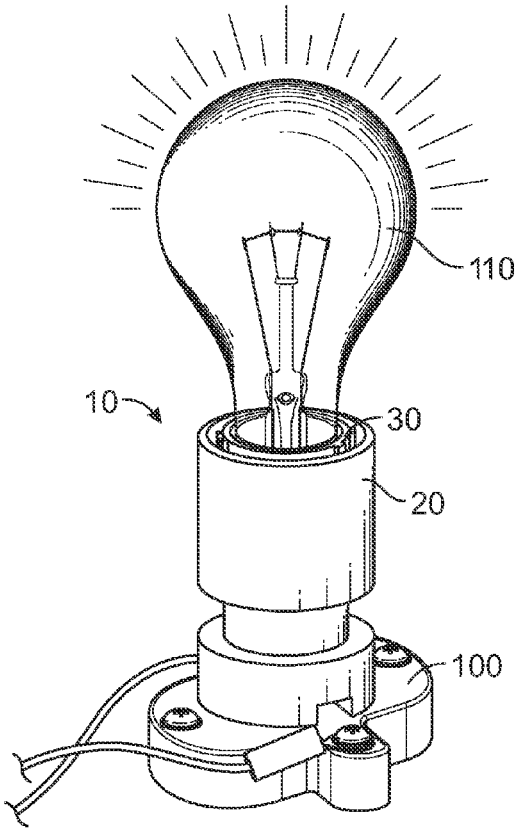
FIG. 1 is a perspective view of light bulb socket assembly 10 screwed into a conventional light bulb socket 100 with conventional light bulb 110 secured within light bulb socket assembly 10, according to an example embodiment.

FIG. 1 is a perspective view of light bulb socket assembly 10 screwed into a conventional light bulb socket 100 with conventional light bulb 110 secured within light bulb socket assembly 10, according to an example embodiment. The conventional light bulb socket 100 shown in FIG. 1 is exemplary only and it could be any socket capable of receiving a conventional light bulb, such as are commonly found on lamps and lighting fixtures. In FIG. 1, a threaded end 32 (shown in FIG. 2) of the inner socket member 30 that serves as an electrical contact has been threaded into conventional light bulb socket 100. An outer sleeve 20 is in its normal secured position around an upper portion of inner socket member 30.

Figure 2:
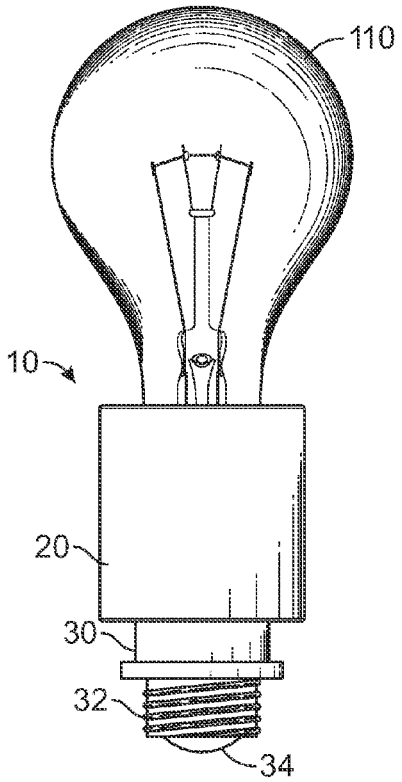
FIG. 2 is a side view of light bulb socket assembly 10 shown in FIG. 1 with conventional light bulb 110 secured within the light bulb socket assembly 10, according to an example embodiment.

FIG. 2 is a side view of light bulb socket assembly 10 shown in FIG. 1 with conventional light bulb 110 secured within the light bulb socket assembly 10. The inner socket member 30 includes a threaded bottom portion 32 that serves as an electrical contact and electrical contact 34 that extends to a point within the inner socket member 30 where it is adapted to contact a corresponding electrical contact on the bottom of conventional light bulb 110.

Figure 3:
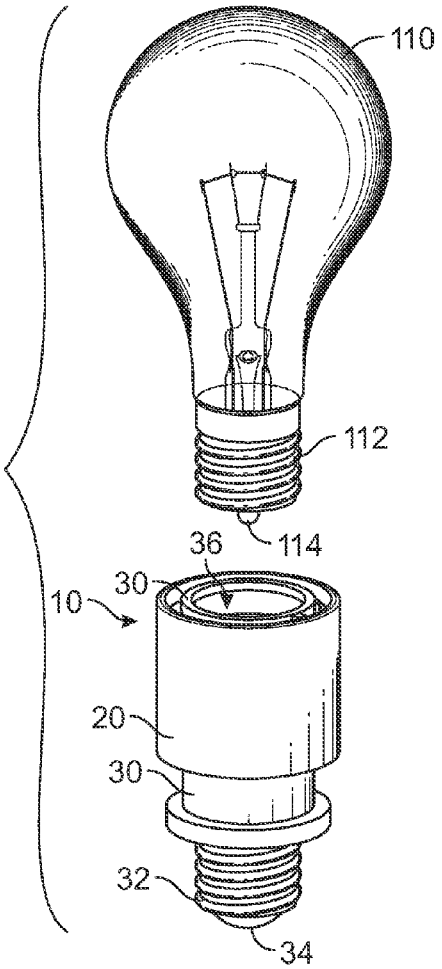
FIG. 3 is a perspective view of light bulb socket assembly 10 shown in FIGS. 1 and 2 prior to installation of light bulb 110, according to an example embodiment.

FIG. 3 is a perspective view of light bulb socket assembly 10 shown in FIGS. 1 and 2 prior to installation of light bulb 110. The inner socket member 30 includes an interior chamber 36 sized and configured to receive the threaded portion 112 of conventional light bulb 110. To more clearly show the functionality of the light bulb socket assembly 10, the assembly 10 is shown in FIGS. 2-14 with the threaded portion 32 of the inner socket member not screwed into a conventional light bulb socket. However, it will be appreciated that in practice the light bulb socket assembly 10 will have its threaded portion 32 screwed into a conventional light bulb socket, such as light bulb socket 100 shown in FIG. 1. Once light bulb 110 is positioned within the light bulb socket assembly 10, as shown for example in FIGS. 1, 2, and 7, the inner socket member 30 is adapted and configured so that the bottom contact 114 of light bulb 110 will be in electrical contact with the bottom contact 34 of the inner socket member, and the threaded portion 112 of light bulb 110 will be in electrical contact with the threaded portion 32 of the inner socket member 30.

Figure 4:
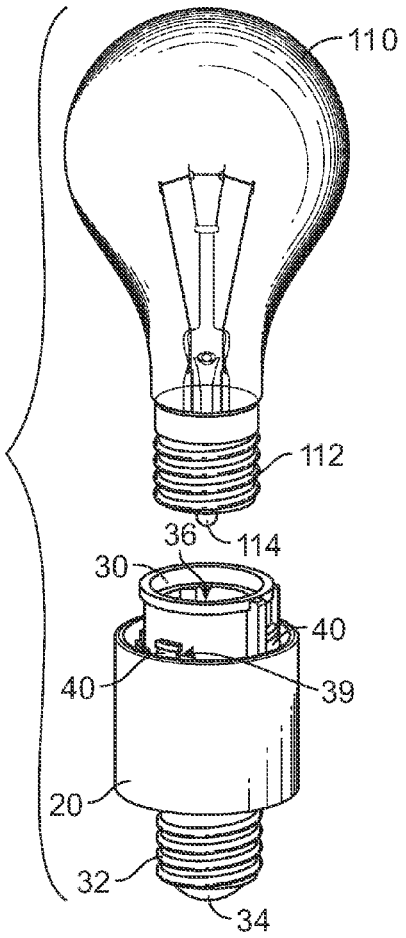
FIG. 4 is a perspective view of light bulb socket assembly 10 shown in FIGS. 1-3 with outer sleeve 20 moved downward relative to inner socket member 30 to a second unsecured position just prior to insertion of light bulb 110.

FIG. 4 is a perspective view of light bulb socket assembly 10 shown in FIGS. 1-3 with outer sleeve 20 refracted, and moved downward relative to inner socket member 30, to a second unsecured position just prior to insertion of light bulb 110. In this unsecured position, with outer sleeve retracted, the locking tabs 40 that extend through the cylindrical wall into the interior chamber 36 into locking engagement with the threads 112 of the light bulb 110 when the outer sleeve is in the secured position as shown in FIGS. 1 and 2, are no longer forced into the interior chamber 36 by an inner surface of the outer sleeve 20, and may now move outwardly to allow for the easy insertion (or removal) of light bulb 110.

Figure 5:
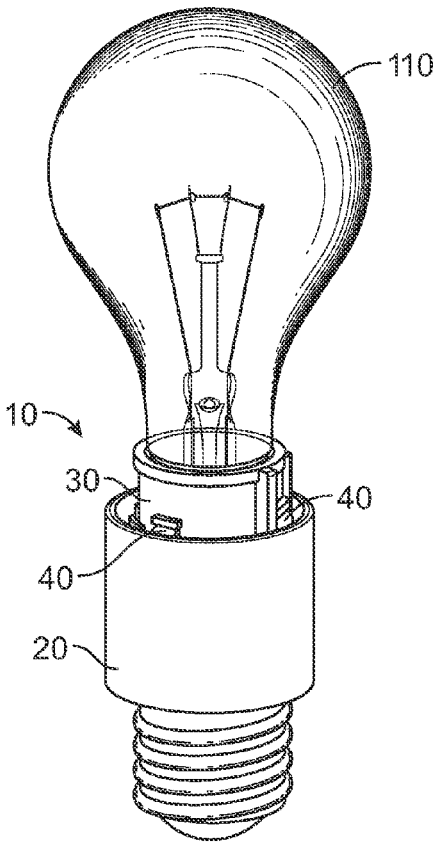
FIG. 5 is a perspective view of light bulb socket assembly 10 shown in FIG. 4 after light bulb 110 has been inserted into the inner socket member 30.

FIG. 5 is a perspective view of light bulb socket assembly 10 shown in FIG. 4 after light bulb 110 has been inserted into the inner socket member 30, with outer sleeve 20 remaining in its unsecured, retracted position, where locking tabs 40 are shown exposed and are not being forced against the threaded portion of light bulb 110.

Figure 6:
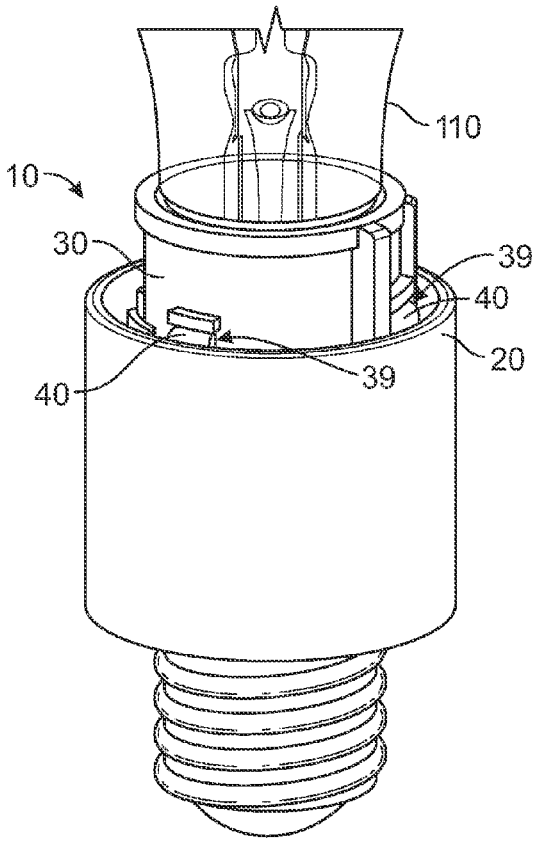
FIG. 6 is a close up perspective view of light bulb socket assembly 10 shown in FIG. 5 where locking tabs 40 can been seen.

FIG. 6 is a close up perspective view of light bulb socket assembly 10 shown in FIG. 5 where locking tabs 40 can been seen exposed and are not being forced against the threaded portion of light bulb 110. The inner socket member 30 and outer sleeve 20 may be made of plastic.

Figure 7:
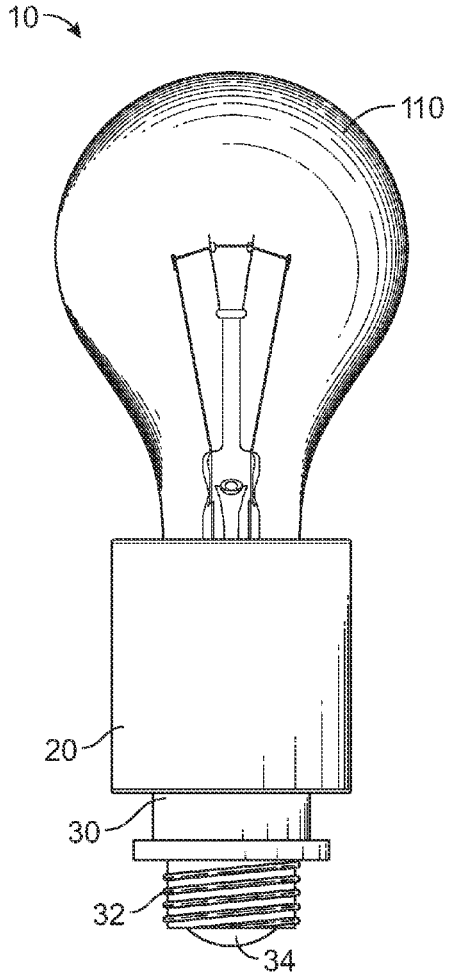
FIG. 7 is a side view of light bulb socket assembly 10 shown in FIGS. 1-6, with light bulb 110 secured within the light bulb socket assembly shown in a first secured position.

In FIG. 7, a side view of light bulb socket assembly 10 shown in FIGS. 1-6 is illustrated, with light bulb 110 secured within the light bulb socket assembly 10, with outer sleeve 20 moved back into a first secured position, where the locking tabs 40 (shown in FIGS. 5 and 6) are now forced into engagement with the threaded portion of light bulb 110 by an inner surface of outer sleeve 20.

Figure 8A:
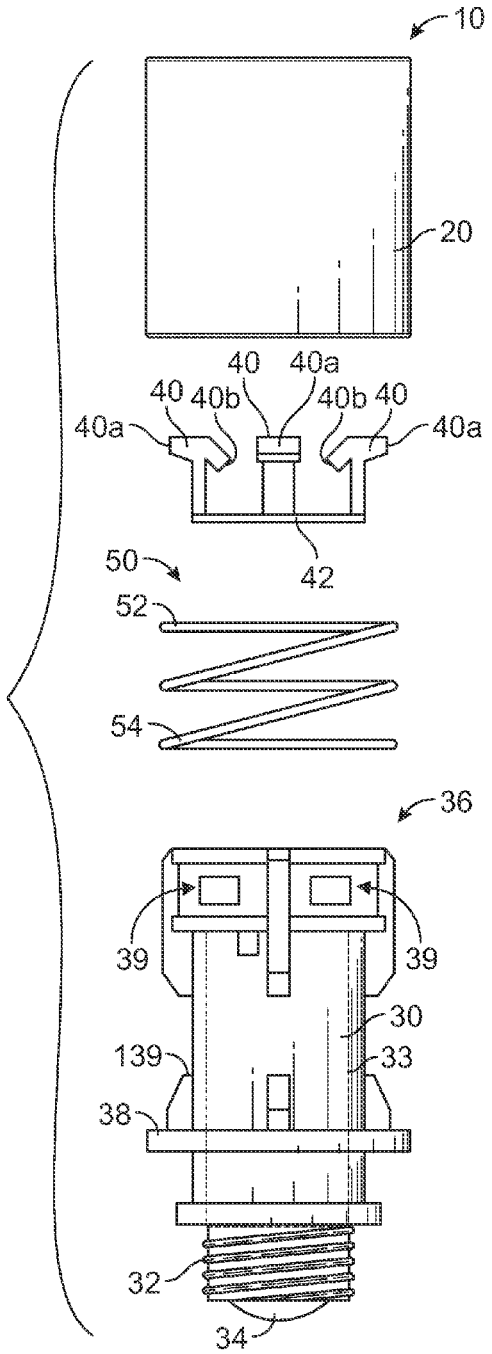
FIG. 8A is an exploded view of the light bulb socket assembly 10 shown in FIGS. 1-7 including outer sleeve 20, inner socket member 30, locking tabs 40, and spring 50, according to an example embodiment.

FIG. 8A is an exploded view of the light bulb socket assembly 10 shown in FIGS. 1-7 including outer sleeve 20, inner socket member 30, locking tabs 40, and spring 50, according to an example embodiment. As will be appreciated, the light bulb socket assembly 10 advantageously comprises a simple, elegant construction including only a small number of pieces, unlike some prior light bulb socket assemblies that have a complex construction and include a multitude of parts. In the case of the present embodiments, the light bulb socket assembly 10 advantageously may be made of only an inner socket member 30, a spring 50, an outer sleeve 20, and locking tabs 40, as well as threaded electrical contact 32 connected to electrical contact 33 positioned against the inner wall of inner socket member 30 to provide electrical contact with the threaded portion 32 of light bulb 110, and electrical contact 34. Inner socket member 30 may include a spring engaging member 38 upon which a bottom 54 of spring 50 rests, and may also include a plurality of ribs 139 upon which a bottom surface of locking tab ring 42 rests. Locking tab ring 42 connects the plurality of locking tabs 40 together. Each locking tab 40 includes an outer surface 40*a* that engages with an inner surface of outer sleeve 20 to force the inner surface 40*b* into engagement with the threads 112 of a conventional light bulb when the outer sleeve is in the first secured position. Top 52 of spring 50 serves to normally bias the outer sleeve 20 into the first secured position by engaging a spring engaging member on the inner surface of the outer sleeve 20. The spring engaging member on the inner surface of the outer sleeve 20 engages the top 52 of spring 50 and compresses spring 50 when the outer sleeve is moved into its retracted, unsecured position.

It will be appreciated that because of the geometric configuration of the inner portions of the locking tabs 40, in some embodiments it may be possible to insert a light bulb into the interior chamber 36 of the light bulb socket assembly simply by pushing the light bulb into the inner socket member 30 even when in the first secured position, because the inner surface 40*b* of the locking tab may be forced outwardly. However, removal of the light bulb is not possible because the geometric configuration of a locking tab acts as a locking tooth, similar to a ratchet that only allows movement in one direction. The locking tabs may be made of nylon or other relatively hard plastic material, or in other embodiments a conductive metal material.

Figure 8B:
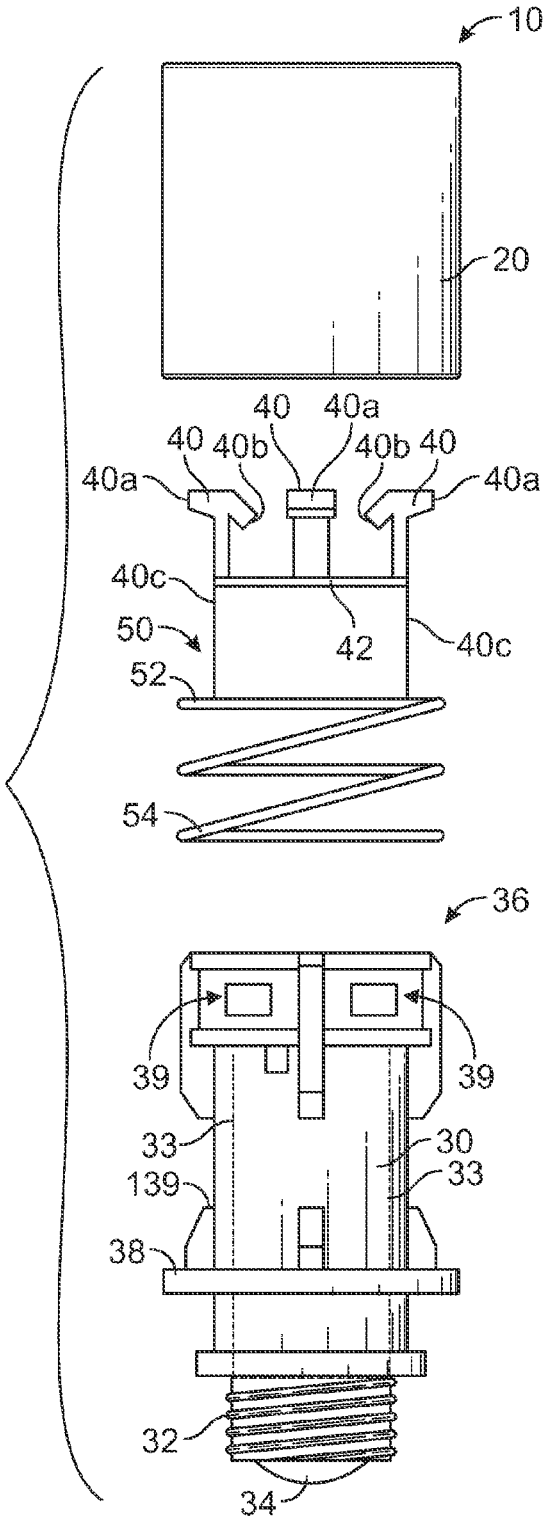
FIG. 8B is an exploded view of the light bulb socket assembly 10 shown in FIGS. 1-7 including outer sleeve 20, inner socket member 30, locking tabs 40, and spring 50, according to an example alternate embodiment where the locking tabs 40 are connected to electrical contacts 40*c* adapted for connection with electrical contacts 33 positioned within the inner socket member 30.

FIG. 8B is an exploded view of the light bulb socket assembly 10 shown in FIGS. 1-7 including outer sleeve 20, inner socket member 30, locking tabs 40, and spring 50, according to an example embodiment where locking tab ring 42 is attached to electrical contact 40*c* adapted for connection with electrical contact 33 positioned against the inner wall of inner socket member 30. In this embodiment the locking tabs 40, locking tab ring 42, and electrical contact 40*c* are made of a conductive material to provide an electrical connection between the threaded base 112 of a light bulb and the threaded portion 32 on the bottom of the inner socket member 30.

As will be appreciated, the light bulb socket assembly 10 advantageously comprises a simple, elegant construction including only a small number of pieces, unlike some prior light bulb socket assemblies that have a complex construction and include a multitude of parts. In the case of the present embodiments, the light bulb socket assembly 10 advantageously may be made of only an inner socket member 30, a spring 50, an outer sleeve 20, and locking tabs 40, as well as threaded electrical contact 32 connected to electrical contact 33 positioned against the inner wall of inner socket member 30 adapted to provide electrical contact with the threaded portion 32 of light bulb 110 and the electrical contact 40*c* extending downwardly from locking tabs 40, and electrical contact 34. Inner socket member 30 may include a spring engaging member 38 upon which a bottom 54 of spring 50 rests, and may also include a plurality of ribs 139 upon which a bottom surface of locking tab ring 42 rests. Locking tab ring 42 connects the plurality of locking tabs 40 together. Each locking tab 40 includes an outer surface 40*a* that engages with an inner surface of outer sleeve 20 to force the inner surface 40*b* into engagement with the threaded portion 112 of a conventional light bulb when the outer sleeve is in the first secured position. Top 52 of spring 50 serves to normally bias the outer sleeve 20 into the first secured position by engaging a spring engaging member on the inner surface of the outer sleeve 20. The spring engaging member on the inner surface of the outer sleeve 20 engages the top 52 of spring 50 and compresses spring 50 when the outer sleeve is moved into its retracted, unsecured position.

Figure 9:
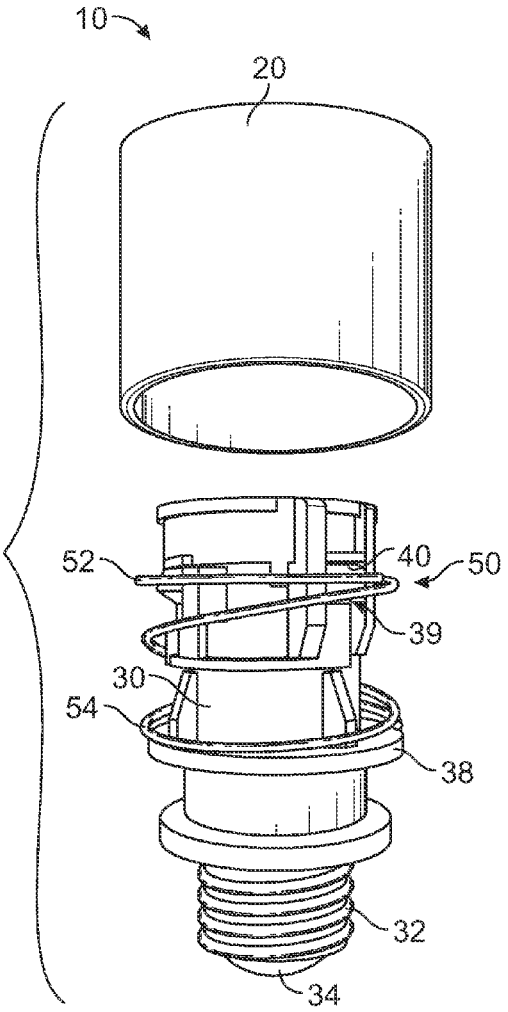
FIG. 9 is a perspective view of light bulb socket assembly 10 shown in FIGS. 1-8 with outer sleeve 20 removed.

FIG. 9 is a perspective view of light bulb socket assembly 10 shown in FIGS. 1-8A with outer sleeve 20 removed. The positioning of the spring 50 about the outside of inner socket member 30 is shown, with the bottom 54 of spring 50 resting on spring engaging member 38 extending outwardly from the inner socket member 30. Other spring arrangements may be used as well, such as where the spring does not surround the inner socket member 30. Different types of springs may also be used, such coil springs, helical springs, strip springs, tension springs, leaf sprints, etc. The locking tabs 40 can be seen extending through apertures 39 in the inner socket member where they may extend into the interior chamber of the inner socket member 30 and engage the threaded portion of a conventional light bulb. In this embodiment, the top 52 of spring 50 is shown positioned over the locking tabs 40.

When the outer sleeve 20 is placed over the inner socket member 30, a spring engaging member (24 in FIG. 11) on the inner surface of the outer sleeve 20 will engage the top 52 of spring 50 and slightly compress the spring 50 such that the outer sleeve 20 is biased by spring 50 into the first secured position where an inner surface of the outer sleeve 20 forces the locking tabs through the aperture 39 into the interior chamber of the inner socket member 30 and into engagement with the threaded portion 112 of a light bulb. In some embodiments, when the outer sleeve 20 is positioned over the inner socket member 30, spring 50, and locking tabs 40, the top 52 of spring 50 may be positioned over the locking tabs 40 and engage the locking tabs 40 to provide the inward force to force the locking tabs 40 into engagement with the threaded portion of a light bulb, as opposed to the inner surface of the outer sleeve 20. With such an arrangement, upon refraction of the outer sleeve 20, a spring engaging member on the inner surface of the outer sleeve 20 would engage the top 52 of spring 50 and compress spring 50, thereby moving the top 52 of spring 50 out of engagement with the locking tabs 40, to place the light bulb socket assembly 10 into an unsecured position with the locking tabs able to freely expand with the top 52 of spring 50 moved out of the way.

Figure 10:
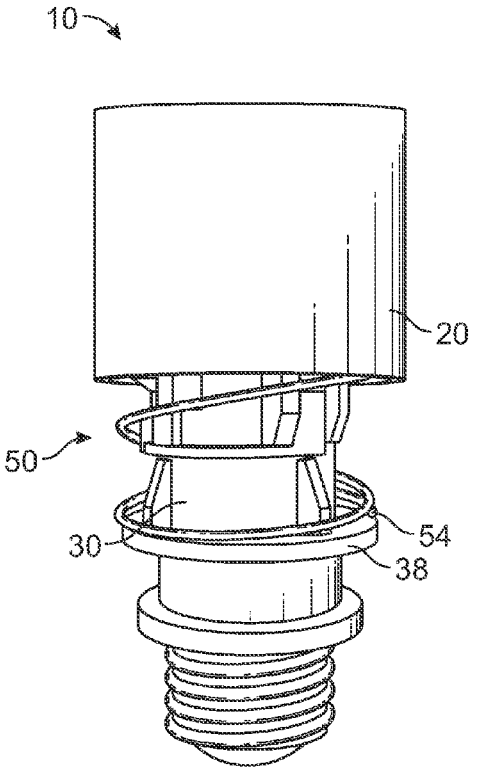
FIG. 10 is a perspective view of light bulb socket assembly 10 shown in FIG. 9 with outer sleeve 20 being moved into position over inner socket member 30 and spring 50.
Figure 13:
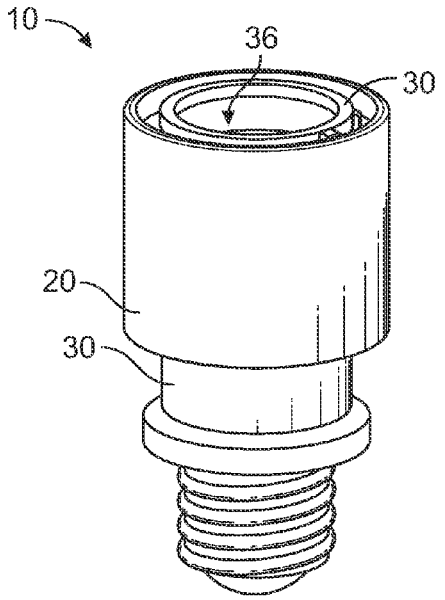
FIG. 13 is a perspective view of light bulb socket assembly 10 shown with outer sleeve 20 in a first secured position as shown in FIG. 11 but without the light bulb 110.

FIG. 10 is a perspective view of light bulb socket assembly 10 shown in FIG. 9 with outer sleeve 20 being moved into position over inner socket member 30 and spring 50. Thus, when outer sleeve is moved into its final position (as shown in FIG. 13), the locking tabs 40 and spring 50 will be positioned within the outer sleeve 20.

Figure 11A:
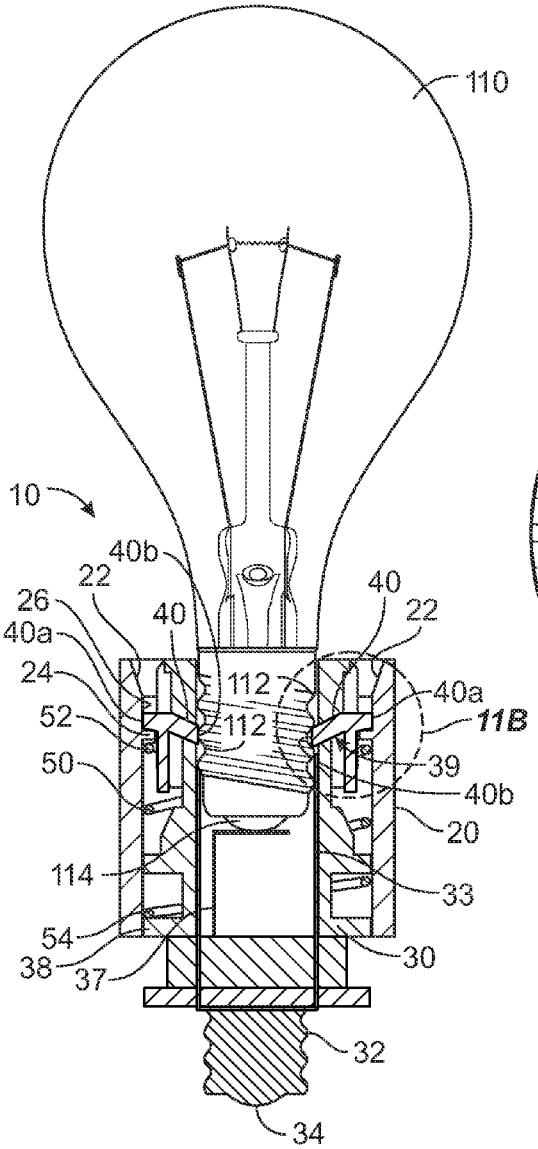
FIG. 11A is a cross-sectional side view of light bulb socket assembly 10 shown in FIGS. 1-8 with light bulb 10 positioned therein with outer sleeve 20 in a first secured position with locking tabs 40 in secure engagement with the threaded base 112 of light bulb 110.

FIG. 11A is a cross-sectional side view of light bulb socket assembly 10 shown in FIGS. 1-8 with light bulb 110 positioned therein with outer sleeve 20 in a first secured position with locking tabs 40 in secure engagement with the threaded base 112 of light bulb 110. In this first secured position, bottom 54 of spring 50 is engaged with spring engaging member 38 outwardly extending from inner socket member 30, and top 52 of spring 50 is positioned beneath spring engaging member 24 on the inner surface of outer sleeve 20. Spring 50 is slightly compressed between spring engaging member 38 and spring engaging member 24 to bias the outer sleeve 20 into the first secured position. In the first secured position, an inner surface 26 of outer sleeve 20 is in engagement with outer surfaces 40*a* of locking tabs 40, which force the inner surfaces 40*b* of locking tabs 40 through apertures 39 in the inner socket member 30 and into locking engagement with threaded portion 112 of light bulb 110. When in this position, the electrical contact 34 on the bottom of inner socket member 30 is in electrical contact with the bottom 114 of light bulb 110 via electrical contact member 37. The threaded portion 32 of inner socket member 30 is also in electrical contact with threads 112 of light bulb 110 via electrical contact 33 positioned on the inner wall of inner socket member 30.

Figure 11B:
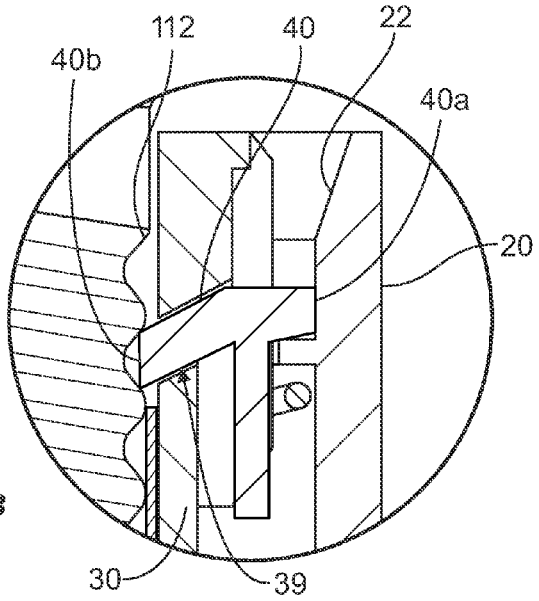
FIG. 11B is a close-up view of circle 11B in FIG. 11A, showing the locking tab 40 having an inner portion 40*b* in securing contact with the threaded base 112 of light bulb 110.

FIG. 11B is a close-up view of view of circle 11B shown in FIG. 11A. Locking tab 40 is shown extending through aperture 39 in the inner socket member 30. The inner wall of the of outer sleeve engages with the outer end 40*a* of the locking tab 40 to force the inner end 40*b* of locking tab 40 to securely engage the threaded portion 112 of the light bulb.

Figure 11C:
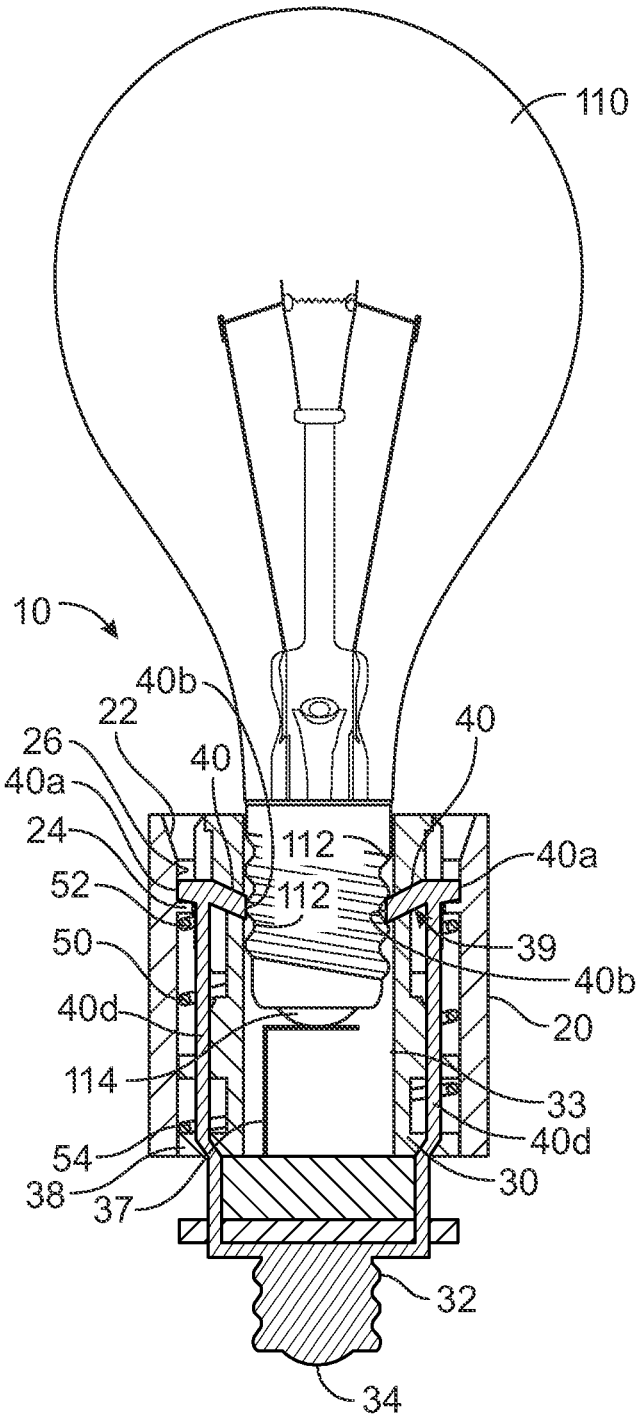
FIG. 11C is a cross-sectional side view of light bulb socket assembly 10 shown in FIGS. 1-8 with light bulb 10 positioned therein with outer sleeve 20 in a first secured position with locking tabs 40 in secure engagement with the threaded base 112 of light bulb 110, where locking tabs 40 include an electrical contact 40*d* extending to the base of inner socket member 30.

FIG. 11C is a cross-sectional side view of light bulb socket assembly 10 with light bulb 110 positioned therein with outer sleeve 20 in a first secured position with locking tabs 40 in secure engagement with the threaded base 112 of light bulb 110. In this first secured position, bottom 54 of spring 50 is engaged with spring engaging member 38 outwardly extending from inner socket member 30, and top 52 of spring 50 is positioned beneath spring engaging member 24 on the inner surface of outer sleeve 20. Spring 50 is slightly compressed between spring engaging member 38 and spring engaging member 24 to bias the outer sleeve 20 into the first secured position. In the first secured position, an inner surface 26 of outer sleeve 20 is in engagement with outer surfaces 40*a* of locking tabs 40, which force the inner surfaces 40*b* of locking tabs 40 through aperture 39 in the inner socket member 30 and into locking engagement with threaded portion 112 of light bulb 110. When in this position, the electrical contact 34 on the bottom of inner socket member 30 is in electrical contact with the bottom 114 of light bulb 110 via electrical contact member 37. In this example embodiment, the locking tab 40 is connected to electrical contact 40*d* that extends downwardly about inner socket member 30 and into electrical contact with the threaded portion 32 of the inner socket member 30. Thus, the threaded portion 32 of inner socket member 30 is also in electrical contact with threads 112 of light bulb 110 via electrical contact 40*d* extending downwardly about inner socket member 30. In this embodiment, the locking tabs 40 and electrical contact 40*d* are made of a conductive metal material.

Figure 12A:
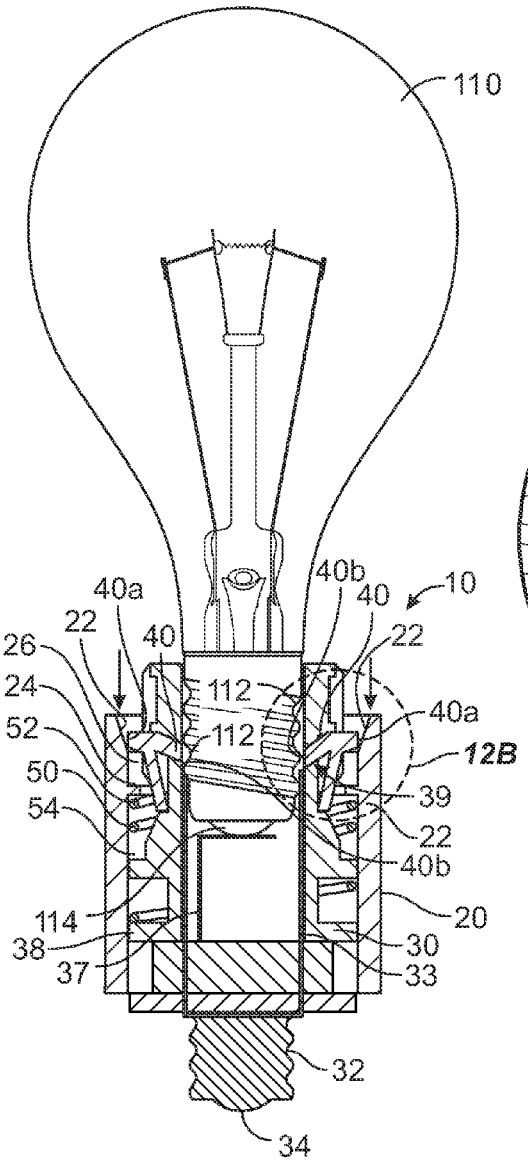
FIG. 12A is a cross-sectional side view of light bulb socket assembly 10 shown in FIG. 11 with outer sleeve 20 moved downward relative to inner socket member 30 to a second unsecured position with locking tabs 40 out of secure engagement with threaded base 112 of light bulb 110.

FIG. 12A is a cross-sectional side view of light bulb socket assembly 10 shown in FIG. 11A with outer sleeve 20 moved downward relative to inner socket member 30 to a second unsecured position with locking tabs 40 out of secure engagement with threaded base 112 of light bulb 110. In particular, when the outer sleeve 20 is retracted, spring 50 is compressed between spring engaging member 38 outwardly extending from inner socket member 30 and spring engaging member 24 on the inner surface of outer sleeve 20. When the outer sleeve 20 is retracted, the inner surface 26 of the outer sleeve 20 is moved out of contact with the outer surfaces 40*a* of the locking tabs 40, and the locking tabs 40 are allowed to expand between the angled surface 22 on the top inner edge of the inner socket member 30 which has a larger diameter than the inner surface 26. In this manner, in the second unsecured position, the light bulb 110 may be easily inserted or removed from the inner socket member 30 as the locking tabs 40 are no longer forced into locking engagement by inner surface 26 of outer sleeve 20.

Figure 12B:
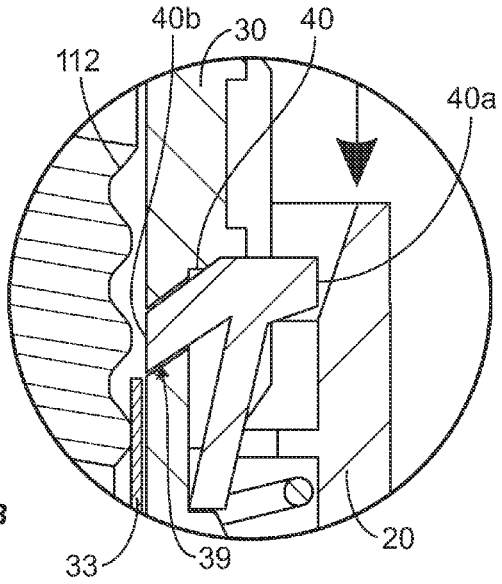
FIG. 12B is a close-up view of circle 12B in FIG. 12A, showing the locking tab 40 having an inner portion 40*b* expanded out of securing contact with the threaded base 112 of light bulb 110 to allow for insertion and removal of light bulb 110.

FIG. 12B is a close-up view of view of circle 12B shown in FIG. 12A. Locking tab 40 is shown having expanded outwardly through aperture 39 in the inner socket member 30, such that the outer end 40*a* is no longer engaged with the inner wall of the of outer sleeve 20 as outer end has been allowed to move towards the angled surface 22 that has a larger diameter than the inner surface of outer sleeve 20 allowing the inner end 40*b* of locking member 40 to become flush with the inner surface of outer sleeve 20. In this position, the locking tab 40 is no longer in secure engagement with the threaded portion 112 of light bulb 110, thereby allowing for removal and/or insertion of light bulb 110.

Figure 12C:
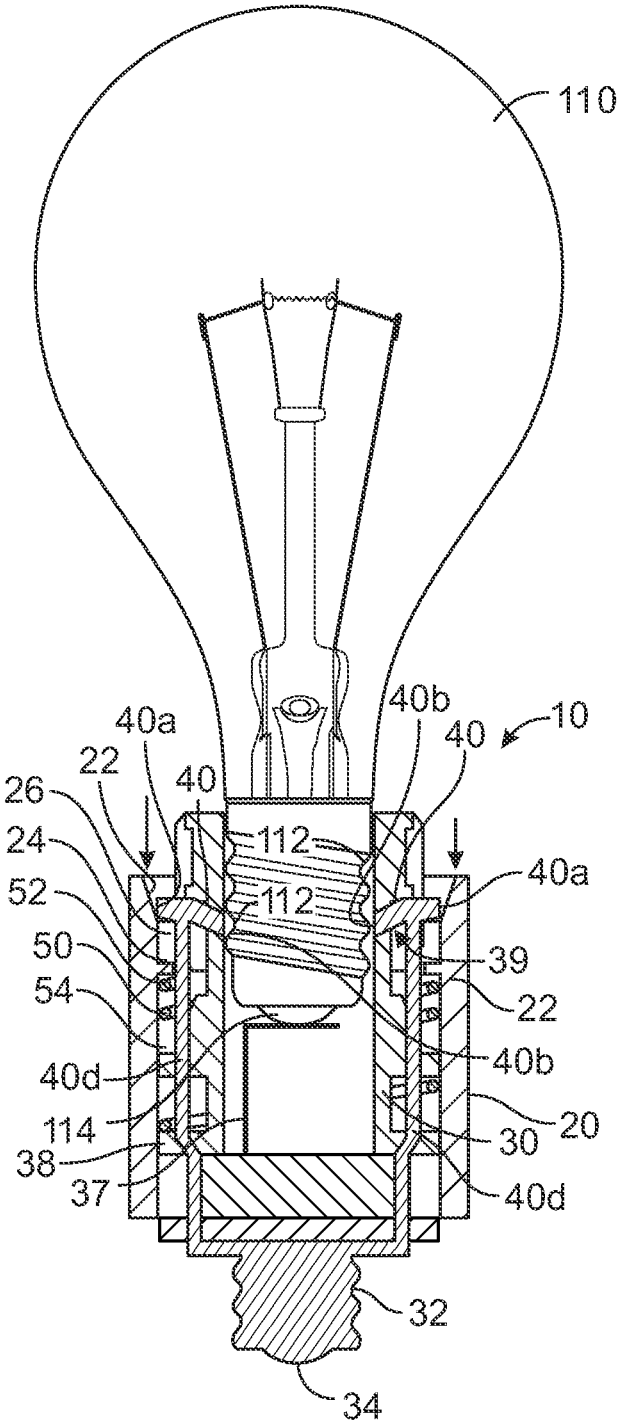
FIG. 12C is a cross-sectional side view of light bulb socket assembly 10 shown in FIGS. 1-8 with light bulb 10 positioned therein with outer sleeve 20 in a first secured position with locking tabs 40 expanded out of secure engagement with the threaded base 112 of light bulb 110, where locking tabs 40 include an electrical contact 40*d* extending to the base of inner socket member 30.

FIG. 12C is a cross-sectional side view of light bulb socket assembly 10 with light bulb 110 positioned therein with outer sleeve 20 in a second unsecured position with locking tabs 40 no longer in secure engagement with the threaded base 112 of light bulb 110. In this second unsecured position, bottom 54 of spring 50 is engaged with spring engaging member 38 outwardly extending from inner socket member 30, and top 52 of spring 50 is positioned beneath spring engaging member 24 on the inner surface of outer sleeve 20. Spring 50 is compressed between spring engaging member 38 and spring engaging member 24 to bias the outer sleeve 20 into the second unsecured position. In the second unsecured position, an inner surface 26 of outer sleeve 20 is no longer in engagement with outer ends 40*a* of locking tabs 40, which no longer force the inner ends 40*b* of locking tabs 40 through aperture 39 in the inner socket member 30. The outer ends 40*a* are allowed to expand against the angled surface 22 on the upper end of the outer sleeve 20. When in this position, the electrical contact 34 on the bottom of inner socket member 30 is in electrical contact with the bottom 114 of light bulb 110 via electrical contact member 37. In this example embodiment, the locking tab 40 is connected to electrical contact 40*d* that extends downwardly about inner socket member 30 and into electrical contact with the threaded portion 32 of the inner socket member 30. Thus, the threaded portion 32 of inner socket member 30 is also in electrical contact with threads 112 of light bulb 110 via electrical contact 40*d* extending downwardly about inner socket member 30. In this embodiment, the locking tabs 40 and electrical contact 40*d* are made of a conductive metal material.

The present embodiments thereby advantageously allow for easy insertion and removal of a light bulb 110 into the light bulb socket assembly 10 when the outer sleeve 20 is retracted to place the light bulb socket assembly 10 into the second unsecured position. Thus, the light bulb 110 may be installed and removed without requiring rotation of the light bulb 10. However, when the light bulb is positioned within the light bulb socket assembly 10 and the outer sleeve 20 is biased into its normal secured position, the light bulb 110 is securely held in place by the locking tabs 40 and cannot be pulled out of the light bulb socket assembly 10.

In some embodiments, such as where the light bulb 110 and light bulb socket assembly 10 are subjected to strong vibrations, it may be desirable to also provide female threads on the inside of the interior chamber 36 of the inner socket member that corresponds to the threaded portion 112 of the light bulb 110 to provide further securing of the light bulb in addition to the locking tabs 40 that would extend through apertures in the female threads of the interior chamber 36.

In addition, the longitudinal positioning of the plurality of locking tabs may be offset such that when the light socket assembly is in the first secured position, the threaded end of the light bulb can be rotated into the inner socket member to install the light bulb, and can also be rotated out of the inner socket member to remove the light bulb.

Figure 14:
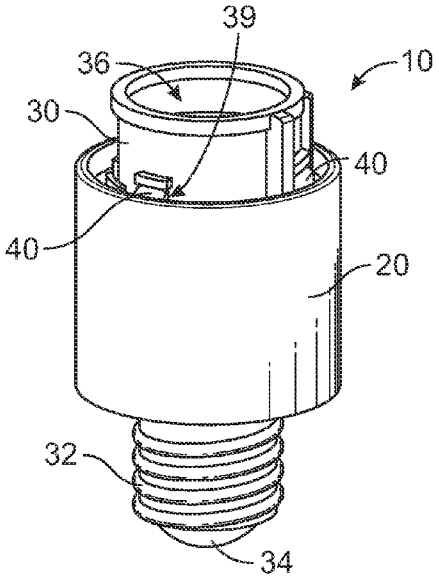
FIG. 14 is a perspective view of light bulb socket assembly 10 shown with outer sleeve 20 in a second unsecured position as shown in FIG. 12 but without the light bulb 110.

FIG. 13 is a perspective view of light bulb socket assembly 10 shown with outer sleeve 20 in a first secured position as shown in FIGS. 11A-11C but without the light bulb 110, where outer sleeve is positioned over the inner socket assembly 30, and an interior chamber 36 is provided that is sized and configured to receive a conventional light bulb. FIG. 14 is a perspective view of light bulb socket assembly 10 shown with outer sleeve 20 retracted into a second unsecured position as shown in FIGS. 12A-12C but without the light bulb 110. In this second unsecured position, the outer sleeve 20 is retracted and the locking tabs 40 are exposed and no longer forced into the interior chamber 36 of inner socket member 30.

As used herein, where it is stated that "the locking tabs are no longer in secured engagement with the threads of the threaded end of the light bulb" this means that although the locking tabs may be in contact with the threads of the threaded end of the light bulb, the light bulb may be removed simply by pulling the light bulb out of the inner socket member, or simply by unscrewing the light bulb in the embodiment where there are female threads on the inner surface of the outer sleeve. Similarly, the term "secured engagement" means that the light bulb cannot be removed from the inner socket member by pulling on the light bulb, with the exception of pulling so hard that the light bulb socket assembly becomes damaged. Furthermore, where it is stated that "the outer sleeve is moved out of forced engagement with the outer sides of the plurality of locking tabs," this means that although the outer sleeve may still be in contact the plurality of locking tabs, the outer sleeve no longer exerts a force on the plurality of locking tabs that is strong enough for the locking tabs to be in "secured engagement" with the threaded portion of the light bulb, and therefore the locking tabs are no longer in secured engagement with the threads of the threaded end of the light bulb.

Example embodiments have been described above. Those skilled in the art will understand that changes and modifications may be made to the described embodiments without departing from the true scope of the present invention, which is defined by the claims.

I claim:

1. A light bulb socket assembly comprising:

an inner socket member having an outer wall defining an interior chamber, where the interior chamber is sized to receive a threaded end of a light bulb;

a threaded member attached to a bottom of the inner socket member, where the threaded member is sized and configured to screw into a conventional light bulb socket;

a spring positioned outside of the outer wall of the inner socket member;

a plurality of locking tabs positioned on an outside of the outer wall of the inner socket member, wherein the tabs are extendable through a corresponding plurality of openings in the outer wall into the interior chamber;

an outer sleeve positioned over the inner socket member, the spring, and the plurality of locking tabs;

wherein the light bulb socket assembly has a first secured position wherein a tab engaging surface on the inner surface of the outer sleeve are forced into engagement with outer sides of the plurality of locking tabs forcing inner sides of the plurality of locking tabs into the interior chamber of the inner socket member such that when a threaded end of a light bulb is positioned within the interior chamber, the light bulb is secured within the inner socket member by the plurality of locking tabs in engagement with the threads of the threaded end of the light bulb;

wherein the light bulb socket assembly has a second unsecured position when the outer sleeve is retracted longitudinally relative to the inner socket member towards a bottom of the inner socket member wherein the spring is compressed, and wherein the tab engaging surface on the inner surface of the outer sleeve is moved out of forced engagement with the outer sides of the plurality of locking tabs such that the locking tabs are no longer in secured engagement with the threads of the threaded end of the light bulb, such that the light bulb may be removed by pulling the light bulb out of the inner socket member.

2. The light bulb socket assembly of claim 1, wherein when the light bulb socket assembly is in the second unsecured position, the threaded end of a light bulb can be pushed into the interior chamber of the inner socket member.

3. The light bulb socket assembly of claim 2, wherein after the threaded end of the light bulb has been inserted into the interior chamber of the inner socket member, longitudinal movement of the outer sleeve back to the first secured position results in the inner surfaces of the plurality of locking tabs moving into secured engagement with the threaded end of the light bulb, such that the light bulb cannot be removed by pulling on the light bulb without damaging the inner socket member.

4. The light bulb socket assembly of claim 1, wherein when the threaded end of the light bulb is positioned in the interior chamber of the inner socket member there is an electrical connection between the bottom end of the light bulb and the bottom end of the threaded member on the bottom of the inner socket member, and there is also an electrical connection between the threads of the threaded end of the light bulb and the threads of the threaded member on the bottom of the inner socket member.

5. The light bulb socket assembly of claim 1, where there is no longitudinal movement of the locking tabs relative to the inner socket member when the outer sleeve is moved to the second unsecured position.

6. The light bulb socket assembly of claim 1, wherein the plurality of locking tabs are interconnected by a locking tab ring that extends around the outside of the inner socket member.

7. The light bulb socket assembly of claim 1, wherein the inner surfaces of the plurality of locking tabs are configured to engage adjacent threads on the threaded end of the light bulb.

8. The light bulb socket assembly of claim 7, wherein the longitudinal positioning of the plurality of locking tabs is offset such that when the light bulb socket assembly is in the first secured position, the threaded end of the light bulb can be rotated into the inner socket member to install the light bulb, and can also be rotated out of the inner socket member to remove the light bulb.

9. The light bulb socket assembly of claim 1, wherein the inner surface of the outer sleeve has an angled surface such that the inner surface of the outer sleeve is no longer in forced engagement with the outer surface of the plurality of locking tabs when the outer sleeve has been moved into the second unsecured position.

10. The light bulb socket assembly of claim 1, wherein the inner surface of the outer sleeve includes a recess such that the inner surface of the outer sleeve is no longer in forced engagement with the outer surface of the plurality of locking tabs when the outer sleeve has been moved into the second unsecured position.

11. The light bulb socket assembly of claim 1, wherein the spring biases the outer sleeve into the first secured position.

12. The light bulb socket assembly of claim 1, further including an outwardly extending protrusion on an outer surface of the outer sleeve operable to assist with movement of the outer sleeve to the second unsecured position.

13. The light bulb socket assembly of claim 1, wherein when the light bulb socket assembly is in the first secured position, the threaded end of a light bulb can be pushed into the interior chamber of the inner socket member, and in the first secured position the inner surfaces of the plurality of locking tabs are in secured engagement with the threaded end of the light bulb, such that the light bulb cannot be removed by pulling on the light bulb without damaging the inner socket member.

14. The light bulb socket assembly of claim 1, wherein the light socket assembly is adapted to receive an E26 conventional light bulb.

15. The light bulb socket assembly of claim 1, wherein the threaded member on the bottom of the inner socket member comprises electrically conductive threads electrically connected to an electrical contact member that extends within the interior chamber of the inner member and is adapted to contact the threaded end of the light bulb when the light bulb is positioned within the inner socket member.

16. The light bulb socket assembly of claim 1, wherein the threaded member on the bottom of the inner socket member comprises electrically conductive threads electrically connected to first electrical contact member that extends within the interior chamber of the inner socket member; and wherein the locking tabs are electrically conductive and are attached to a second electrical contact downwardly extending within the interior chamber of the inner socket member to provide an electrical contact between the first electrical contact member and the second electrical contact member.

17. The light bulb socket assembly of claim 1, wherein the threaded member on the bottom of the inner socket member comprises electrically conductive threads;

wherein the locking tabs are electrically conductive and include an electrical contact extension that extends downwardly and into electrical contact with the threaded member on the bottom of the inner socket member to provide an electrical contact between threaded portion of a light bulb and the threaded member on the bottom of the inner socket member.

18. The light bulb socket assembly of claim 1, wherein the spring is positioned around the outside of the outer wall of the inner socket member;

wherein a first spring engaging member is positioned on an outer surface of the inner socket member above the threaded member, and a bottom end of the spring is positioned against the first spring engaging member; and wherein a second spring engaging member is positioned on an inner surface of the outer sleeve, and a top end of the spring is positioned against the second spring engaging member.

19. A light bulb socket assembly comprising:

an inner socket member having an outer wall defining an interior chamber, where the interior chamber is sized to receive a threaded end of a light bulb;

a threaded member attached to a bottom of the inner socket member, where the threaded member is sized and configured to screw into a conventional light bulb socket;

a spring positioned outside of the outer wall of the inner socket member;

a plurality of locking tabs positioned on an outside of the outer wall of the inner socket member, wherein the plurality of locking tabs are extendable through a corresponding plurality of openings in the outer wall into the interior chamber;

an outer sleeve positioned over the inner socket member, the spring, and the plurality of locking tabs;

wherein the light bulb socket assembly has a first secured position wherein a top surface of the spring is forced into engagement with outer sides of the plurality of locking tabs forcing inner sides of the plurality of locking tabs into the interior chamber of the inner socket member such that when a threaded end of the light bulb is positioned within the interior chamber, the light bulb is secured within the inner socket member by the plurality of locking tabs in engagement with the threads of the threaded end of the light bulb;

wherein the light bulb socket assembly has a second unsecured position when the outer sleeve has been moved longitudinally relative to the inner socket member towards a bottom of the inner socket member wherein the spring is compressed, and the top of the spring is moved out of forced engagement with the outer sides of the plurality of locking tabs such that the locking tabs are no longer in secured engagement with the threads of the threaded end of the light bulb, such that the light bulb may be removed by pulling the light bulb out of the inner socket member.

20. The light bulb socket assembly of claim 19, wherein a first spring engaging member is positioned on an outer surface of the inner socket member above the threaded member, and a bottom end of the spring is positioned against the first spring engaging member; and wherein a second spring engaging member is positioned on an inner surface of the outer sleeve, and a top end of the spring is positioned against the second spring engaging member.

21. A light bulb socket assembly comprising:

an inner socket member having an outer wall defining an interior chamber, where the interior chamber is sized to receive a threaded end of a light bulb;

a threaded member attached to a bottom of the inner socket member, where the threaded member is sized and configured to screw into a conventional light bulb socket;

a spring positioned outside of the outer wall of the inner socket member;

a plurality of locking tabs positioned on the outside of the outer wall of the inner socket member, wherein the tabs are extendable through a corresponding plurality of openings in the outer wall into the interior chamber;

an outer sleeve positioned over the inner socket member, the spring, and the plurality of locking tabs;

wherein the light bulb socket assembly has a first secured position wherein a tab engaging surface on the inner surface of the outer sleeve is forced into engagement with outer sides of the plurality of locking tabs forcing inner sides of the plurality of locking tabs into the interior chamber of the inner socket member such that when a threaded end of a light bulb is positioned within the interior chamber, the light bulb is secured within the inner socket member by the plurality of locking tabs in engagement with the threads of the threaded end of the light bulb;

wherein the inner surface of the interior chamber of the inner socket member includes female threads adapted to receive the threaded end of the light bulb, and wherein the openings in the outer wall extend through openings in the female threads in the interior chamber of the inner socket member such that the locking tabs engage the threaded end of the light bulb when the light bulb has been threaded into the interior chamber of the inner socket member when the light bulb socket assembly is in the first secured position; and wherein the light bulb socket assembly has a second unsecured position when the outer sleeve has been moved longitudinally relative to the inner socket member towards a bottom of the inner socket member wherein the spring is compressed, and wherein a tab engaging surface on the inner surface of the outer sleeve is moved out of forced engagement with outer sides of the plurality of locking tabs such that the locking tabs are no longer in secured engagement with the threads of the threaded end of the light bulb, such that the light bulb may be removed by unscrewing the threaded end of the light bulb from the female threads in the interior chamber of the inner socket member.

22. A light bulb socket assembly consisting essentially of:

an inner socket member having an outer wall defining an interior chamber, where the interior chamber is sized to receive a threaded end of a light bulb;

a threaded member attached to a bottom of the inner socket member, where the threaded member is sized and configured to screw into a conventional light bulb socket;

an electrical contact extending between the threads of the threaded member and the interior chamber of the inner socket member adapted to electrically connect to the threaded end of the light bulb when it is positioned within the interior chamber;

an electrical contact extending between the bottom of the threaded member and the interior chamber of the inner socket member adapted to electrically connect to the bottom of the threaded end of the light bulb when it is positioned within the interior chamber;

a spring positioned outside of the outer wall of the inner socket member;

a plurality of locking tabs positioned on the outside of the outer wall of the inner socket member, wherein the locking tabs are extendable through a corresponding plurality of openings in the outer wall into the interior chamber;

an outer sleeve positioned over the inner socket member, the spring, and the plurality of locking tabs;

wherein the light bulb socket assembly has a first secured position wherein a tab engaging surface on the inner surface of the outer sleeve is forced into engagement with outer sides of the plurality of locking tabs forcing inner sides of the plurality of locking tabs into the interior chamber of the inner socket member such that when a threaded end of the light bulb is positioned within the interior chamber, the light bulb is secured within the inner socket member by the plurality of locking tabs in engagement with the threads of the threaded end of the light bulb;

wherein the light bulb socket assembly has a second unsecured position when the outer sleeve is moved longitudinally relative to the inner socket member towards a bottom of the inner socket member wherein the spring is compressed, and wherein the tab engaging surface on the inner surface of the outer sleeve is moved out of forced engagement with the outer sides of the plurality of locking tabs such that the locking tabs are no longer in secured engagement with the threads of the threaded end of the light bulb, such that the light bulb may be removed by pulling the light bulb out of the inner socket member.

* * * * *